US006925808B2

(12) United States Patent
Tiemann

(10) Patent No.: US 6,925,808 B2
(45) Date of Patent: Aug. 9, 2005

(54) COMBUSTION CHAMBER WITH A CLOSED COOLING SYSTEM FOR A TURBINE

(75) Inventor: Peter Tiemann, Witten (DE)

(73) Assignee: Siemens Aktiengesellschaft, Munich (DE)

( * ) Notice: Subject to any disclaimer, the term of this patent is extended or adjusted under 35 U.S.C. 154(b) by 62 days.

(21) Appl. No.: 10/724,810

(22) Filed: Dec. 1, 2003

(65) Prior Publication Data

US 2004/0118123 A1 Jun. 24, 2004

(30) Foreign Application Priority Data

Dec. 19, 2002 (EP) ..... 02028486

(51) Int. Cl.[7] ..... F23R 3/50
(52) U.S. Cl. ..... 60/722; 60/752
(58) Field of Search ..... 60/722, 752

(56) References Cited

U.S. PATENT DOCUMENTS 5,363,654 A * 11/1994 Lee ..... 60/752
5,467,815 A 11/1995 Haumann et al.
5,737,922 A 4/1998 Schoenman et al.

FOREIGN PATENT DOCUMENTS

| | | |
|---|---|---|
| DE | 198 09 568 A 1 | 8/1999 |
| EP | 0 624 757 A1 | 11/1994 |
| EP | 1 271 056 A1 | 1/2003 |
| WO | WO 99/61841 | 12/1999 |

* cited by examiner

*Primary Examiner*—Ehud Gartenberg

(57) ABSTRACT

In order to develop a combustion chamber with a closed cooling system for a turbine with an inner wall and an outer wall (1) bounding the combustion area, wherein there is an intermediate space between the inner wall and the outer wall (1) through which cooling fluid can flow, and which comprises a cooling fluid feed system opening out into the intermediate space and a cooling fluid discharge system for discharging the cooling fluid from the intermediate space, so that it has a reduced extension in the radial direction, it is proposed with the invention that the cooling fluid discharge system should comprise channel-type drainage structures (8) running essentially along the axial orientation of the combustion chamber, which are interrupted by inlet structures (4) of the cooling fluid feed system arranged between the drainage structures (8).

15 Claims, 4 Drawing Sheets

COMBUSTION CHAMBER WITH A CLOSED COOLING SYSTEM FOR A TURBINE

CROSS REFERENCE TO RELATED APPLICATIONS

This application claims priority to the European application No. 02028486.5 EP, filed Dec. 19, 2002 under the European Patent Convention and which is incorporated by reference herein in its entirety.

FIELD OF INVENTION

The invention relates to a combustion chamber with a closed cooling system for a turbine.

BACKGROUND OF INVENTION

Combustion chambers of this type are enclosed by a double wall comprising an inner wall and an outer wall, whereby there is an intermediate space between the inner wall and the outer wall, through which a cooling fluid, generally cooling air, can flow. To cool the combustion chamber, a cooling fluid, generally cooling air, is fed into the intermediate space through a cooling fluid feed system opening out into the intermediate space, and the cooling fluid leaves the intermediate space via a cooling fluid discharge system after absorbing the heat to be discharged from the combustion chamber. With known combustion chambers with closed cooling systems the outer wall is frequently configured as a double-layer hollow tile, whereby the hollow tiles are configured by cooling fluid feed tubes penetrating and opening out into the intermediate space between the outer wall and the inner wall. The cavity formed in the hollow tile and interrupted by the feed tubes is used to discharge the heated cooling fluid. The cooling fluid is discharged here inside the hollow tile generally in the axial direction of the combustion chamber. The problem with this structure is that the tubes with a circular cross-section fed through the hollow tile block the flow path for the discharging cooling fluid with their walls crossing the hollow tile, thereby increasing the flow resistance for the discharging cooling fluid. It is therefore usual with such hollow tiles to increase the extension in the radial direction of the burner, i.e. in the direction of the tubes projecting through the hollow tile. A radial extension of the housing is inevitably associated with this increase in radial extension, requiring a greater use of material to manufacture the housing on the one hand and on the other hand an increase in the space requirement for the combustion chamber as a whole.

SUMMARY OF INVENTION

Given this prior art, the object of the invention is to improve a combustion chamber with a closed cooling system for a turbine so that it allows reliable and low-resistance discharge of the cooling fluid with a smaller radial extension.

To achieve this object the invention specifies a combustion chamber with a closed cooling system for a turbine with an inner wall and an outer wall bounding the combustion area, whereby there is an intermediate space between the inner wall and the outer wall through which cooling fluid can flow, with a cooling fluid feed system opening out into the intermediate space and a cooling fluid discharge system to discharge the cooling fluid from the intermediate space, whereby the cooling fluid discharge system comprises channel-type drainage structures running essentially along the axial orientation of the combustion chamber, which are interrupted by inlet structures for the cooling fluid feed system arranged between the drainage structures.

Because the cooling fluid discharge point system comprises channel-type drainage structures running in the axial direction of the combustion chamber, in which there are no obstacles to the flow, the cooling fluid can be discharged in these drainage structures without a high level of flow resistance. Compared with the known hollow tile, through which a plurality of individual tubes project in a regular arrangement, with the design according to the invention the cooling fluid to be discharged is channeled through the channel-type drainage structures and discharged with reduced flow resistance with the same radial extension of the combustion chamber.

According to a first embodiment of the combustion chamber according to the invention, the outer wall is configured as a double-layer hollow tile and the drainage structures inside the hollow tile are intermediate walls of feed tubes arranged in rows one behind the other in the axial direction of the combustion chamber and projecting through the hollow tile to feed in the cooling fluid, whereby the feed tubes have an opening cross-section that is longitudinally extended in the direction of the combustion chamber, at least in the outer layer of the hollow tile. Because unlike with the known outer wall configured as a double-layer hollow tile, the feed tubes projecting through the hollow tile do not have a completely circular cross-section, but have an opening cross-section that is longitudinally extended in the axial direction of the combustion chamber at least in the outer layer of the hollow tile and are arranged in rows one behind the other in the axial direction of the combustion chamber, a drainage channel for the cooling fluid running in the axial direction of the combustion chamber is configured between the walls of the feed tubes in two adjacent rows. The cooling fluid can flow through this with significantly less flow resistance than with the known design.

According to a development of this embodiment, the narrow sides of the feed tubes in the rows arranged in the axial direction of the combustion chamber are at a shorter distance from each other at least in the outer layer of the hollow tile than the distance between the openings in adjacent rows. This configuration ensures even better channeling of the discharging cooling fluid in the channels configured between the rows.

Also according to a development of the first embodiment the feed tubes in the outer layer of the hollow tile can have an opening cross-section with a longitudinally extended form and in the inner layer of the hollow tile a circular opening cross-section. Such a configuration on the one hand has the advantage of the channel-type drainage structure for the cooling fluid, while on the other hand maintaining the circular form of the opening of the feed tube opening out into the intermediate space, which is favorable for feeding in cooling fluid. The feed tube is hereby formed along its axial extension so that it makes the transition from the longitudinally extended "slot shape" of the opening in the outer layer of the hollow tile to the circular opening in the inner layer of the hollow tile, while avoiding an increase in flow resistance.

According to a further development of the first embodiment, the outer layer of the hollow tile comprises a sealing plate that is attached, preferably screwed on, in a detachable manner, which seals an opening, through which a section of the inner layer that is attached, preferably screwed on, in a detachable manner, is accessible. The access required for example for maintenance and repair purposes to the inner wall enclosing the combustion chamber can easily be obtained with this design. If a sealable opening is also provided in this wall instead of the access openings in the hollow tile, the inside of the combustion chamber is also accessible. The sealing plate solution also has the advantage that an opening can be provided in the double-layer hollow tile without an increase in design overhead. This design is characterized by a small number of components which can also be implemented in precisely the same way as the remainder of the hollow tile enclosing the opening.

According to a second embodiment of the present invention, the drainage structures are formed by drainage channels formed on the outer wall and running in the axial direction of the combustion chamber, between which the inlet structures are each arranged. With this embodiment generally a single-layer wall is used as the outer wall of the combustion chamber instead of a double-wall hollow tile, with individual drainage channels running in the axial direction of the combustion chamber and arranged on the outside of said single-layer wall. The manufacture of such an in principle single-layer outer wall is considerably simpler than in the case of the hollow tile, as these parts are generally cast parts.

According to a development of this second embodiment, the circular drainage openings formed in the outer wall open out into the drainage channels. To discharge the cooling fluid leaving the gap between the outer wall and the inner wall, circular drainage openings are distributed over the outer wall. The circular shape of the drainage openings is advantageous for reasons of flow engineering. A plurality of circular drainage openings open out into one of the drainage channels, in which the discharged cooling fluid is collected and discharged in a specific direction.

According to a further development of the second embodiment, the drainage channels on the outer wall are formed by covers on ribs running in the axial direction of the combustion chamber and configured on the outside of the outer wall. Such a two-part design of the drainage channels allows an even more simplified manufacturing method for the outer walls. These can be manufactured as a simple, single-layer cast part. Only the ribs have to be configured during casting. It is not necessary to configure hollows in the form of drainage channels. These are not formed until later by fitting the covers.

According to a further development the bases of the ribs can comprise structures for making the transition from circular openings to a linear channel. An embodiment of this type means that cooling fluid can be discharged with maximum efficiency with a comparatively small drainage channel width from circular openings in the outer layer, which are distributed over a wide area of the outer layer. The comparatively small channel width is necessary to maintain sufficient space between the channels for the configuration of openings for the cooling fluid feed system.

Finally, for the second embodiment, according to a further development of the invention the outer wall is in the form of a single-layer cast part and the covers are welded onto the ribs.

BRIEF DESCRIPTION OF THE DRAWING

Further advantages and features of the invention will emerge from the description which follows of exemplary embodiments with reference to the attached figures, in which.

The same elements are assigned the same reference numbers in the figures.

DETAILED DESCRIPTION OF INVENTION

Figure 1:
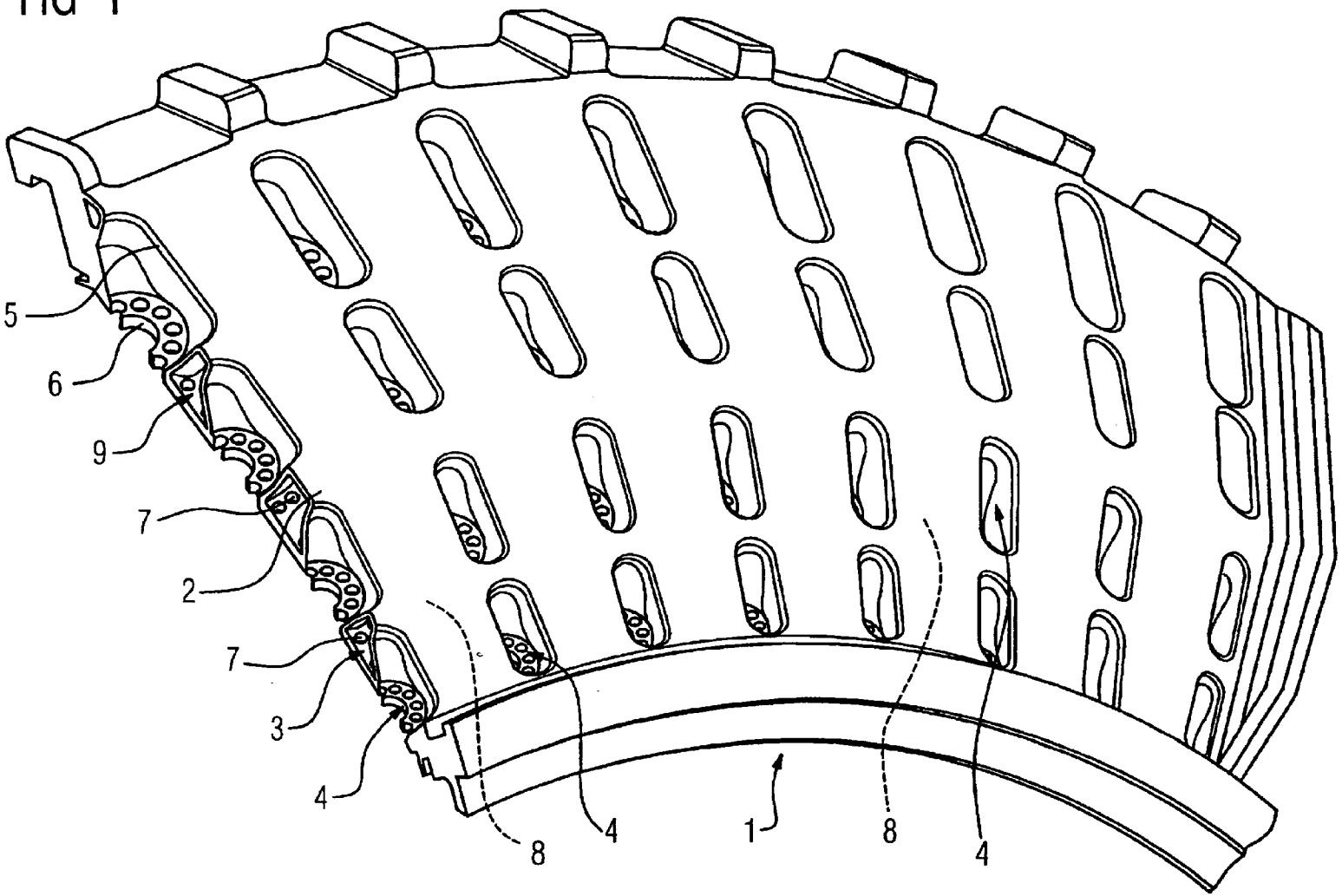
FIG. 1 shows a three-dimensional representation of a section from an outer wall configured as a hollow tile in a combustion chamber with a closed cooling system.

FIG. 1 shows a first embodiment of an outer wall 1 of a combustion chamber according to the invention in a sectional, three-dimensional representation. The outer wall 1 is configured as a double-layer hollow tile. It comprises an outer layer 2 and an inner layer 3 facing towards the combustion chamber. Feed tubes 4 connect the outer layer 2 and the inner layer 3 together to feed in a cooling fluid. The feed tubes 4 have longitudinally extended oval openings 5 in the outer layer 2 and circular openings 6 in the inner layer 3. The feed tubes 4 here are arranged in rows one behind the other in the axial direction of the combustion chamber so that the narrow front faces of the longitudinally extended oval openings 5 abut each other firmly and there is a greater distance between the oval openings 5 of feed tubes 4 in adjacent rows than between the openings 5 in the rows. This means that channel-type drainage structures 8 running in the axial direction of the combustion chamber are created between the rows of feed tubes 4 to discharge cooling fluid in the cavity 9 formed between the outer layer 2 and the inner layer 3 of the outer wall 1 configured as a hollow tile. The cooling fluid to be discharged leaves an intermediate space (not shown) between the outer wall 1 and an inner wall (not shown) of the double-wall combustion chamber and passes through openings 7 into the cavity 9. There it enters the channel-type drainage structures 8 and is discharged in a directed manner in the axial direction of the burner inside the outer wall 1 configured as a hollow tile.

Fresh cooling fluid is fed into the intermediate space between the outer wall 1 and the inner wall (not shown) through the feed tubes 4, the walls of which make the transition from the oval opening 5 to a circular opening 6. The embodiment and arrangement of the feed tubes 4 shown are such that channel-type drainage structures 8 are formed inside the hollow tile, allowing the directed discharge of cooling fluid with a low flow-resistance. This allows a smaller extension of the outer wall in the radial direction, i.e. in the direction of the axial orientation of the feed tubes 4, compared with known hollow tile variants.

Figures 2A, 2B:
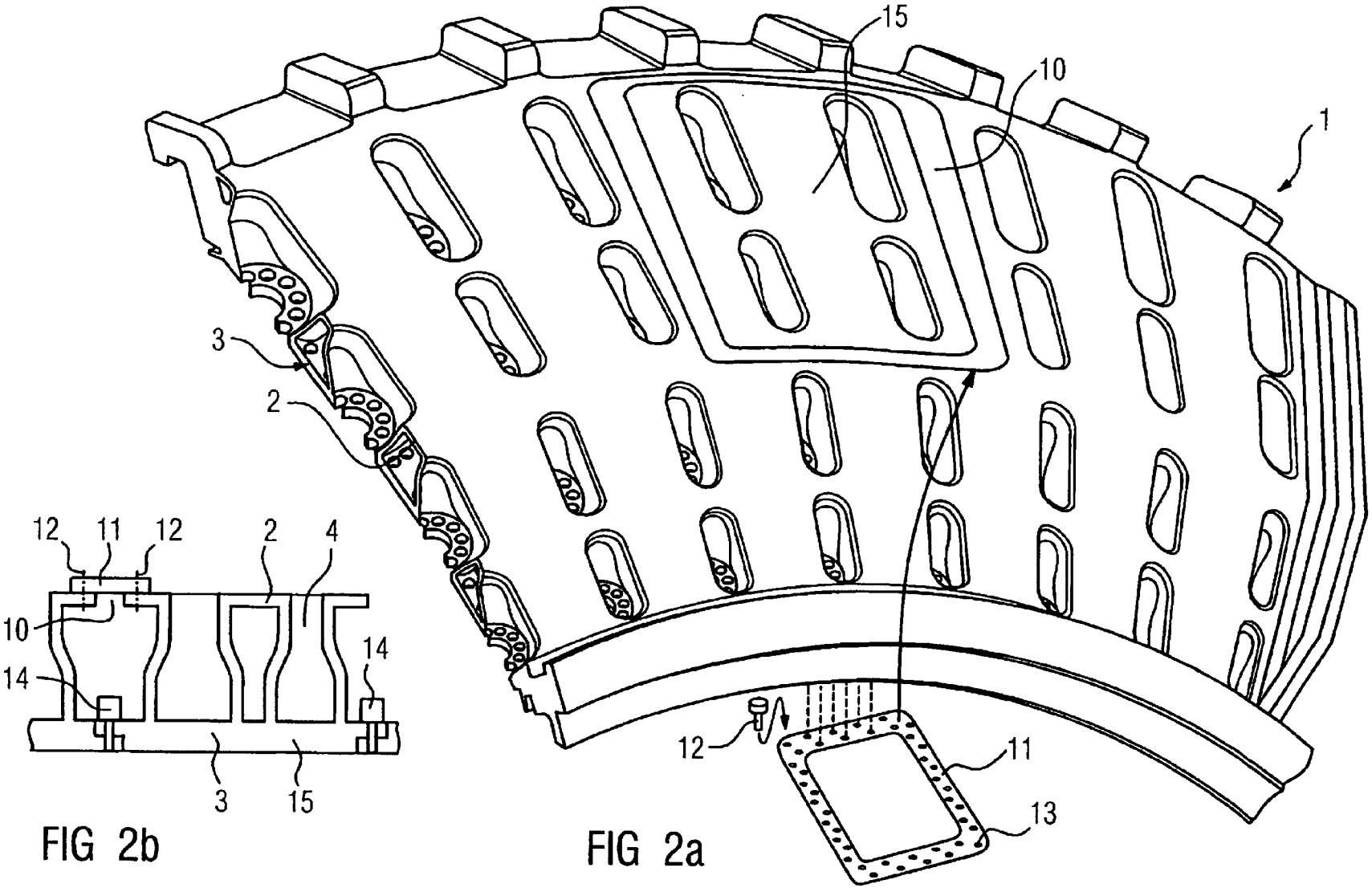
FIG. 2*a* shows a section comparable to the one in FIG. 1 with an integrated, removable segment to form a manhole.
FIG. 2*b* shows a schematic representation of a section through the removable segment and adjacent areas of the outer wall.

FIGS. 2*a* and 2*b* show a possible development of the outer wall shown in FIG. 1. To form an opening for repair and maintenance purposes for example, known as a manhole, a circumferential recess is configured in the outer layer 2 of the outer wall 1 configured as a hollow tile, through which studs 14 are accessible. The studs 14 are used to attach a removable segment 15 to the remainder of the outer wall 1 configured as a hollow tile. During operation the recess 10 is sealed by means of a screwed on sealing plate 11. For this purpose the sealing plate 11 has openings 13, through which studs 12 are fed and screwed to the outer layer 2. The removable segment 15 is configured with a structure that is the same as the remainder of the outer layer 1. This allows simplified manufacture of the removable segment 15 in the same way as the remainder of the outer wall 1 configured as a hollow tile. To remove the removable segment 15, the sealing plate 11 is simply detached from the outer layer 2 and removed. The studs 14 are then accessible through the recess 10 and once they have been released, the removable segment 15 can be removed.

Figure 3:
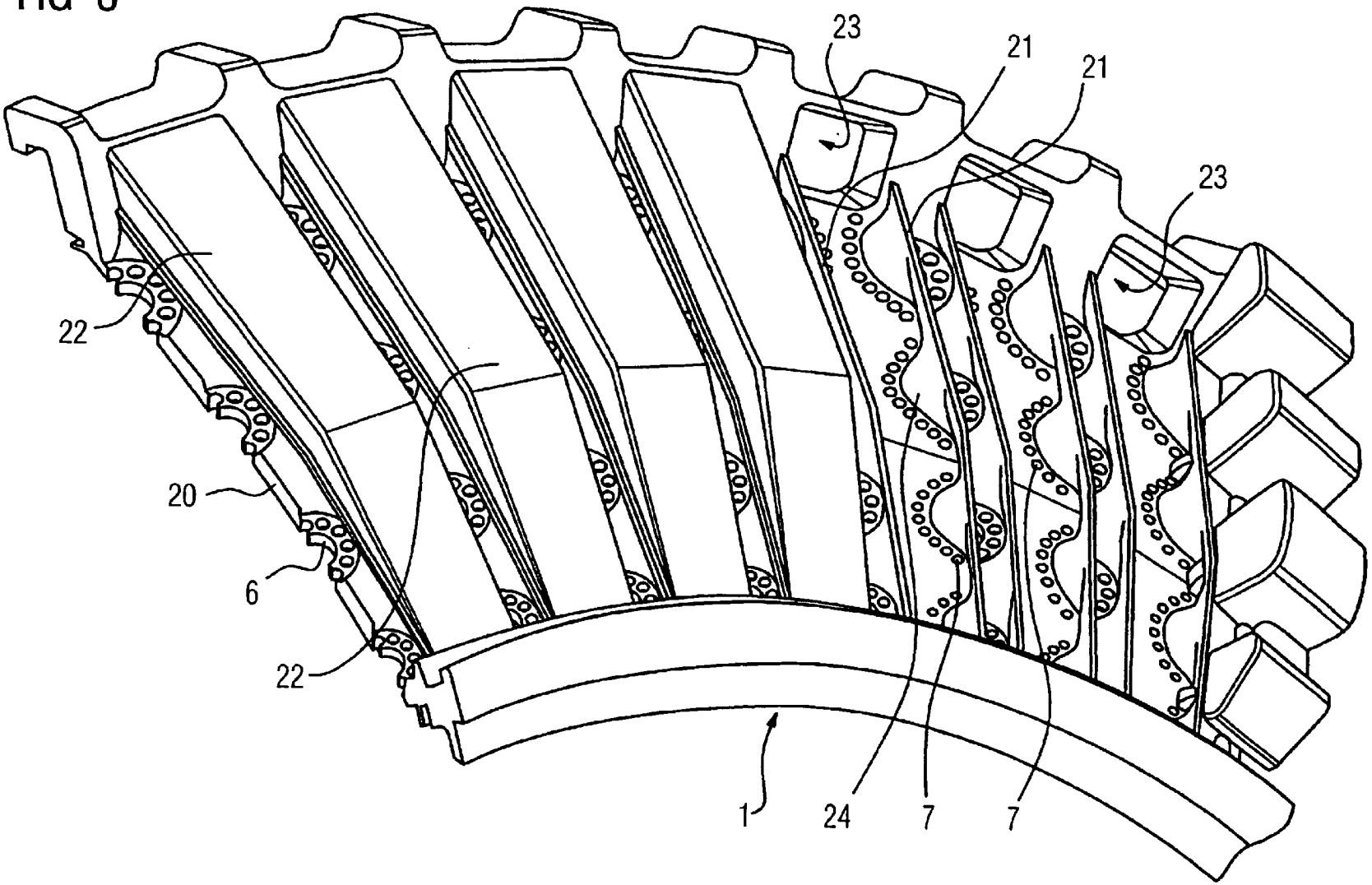
FIG. 3 shows a perspective representation of a section of an outer wall of a combustion chamber with a closed cooling system according to a second embodiment and FIG. 4 shows an enlargement of a detailed view of the embodiment according to FIG. 3.
Figure 4:
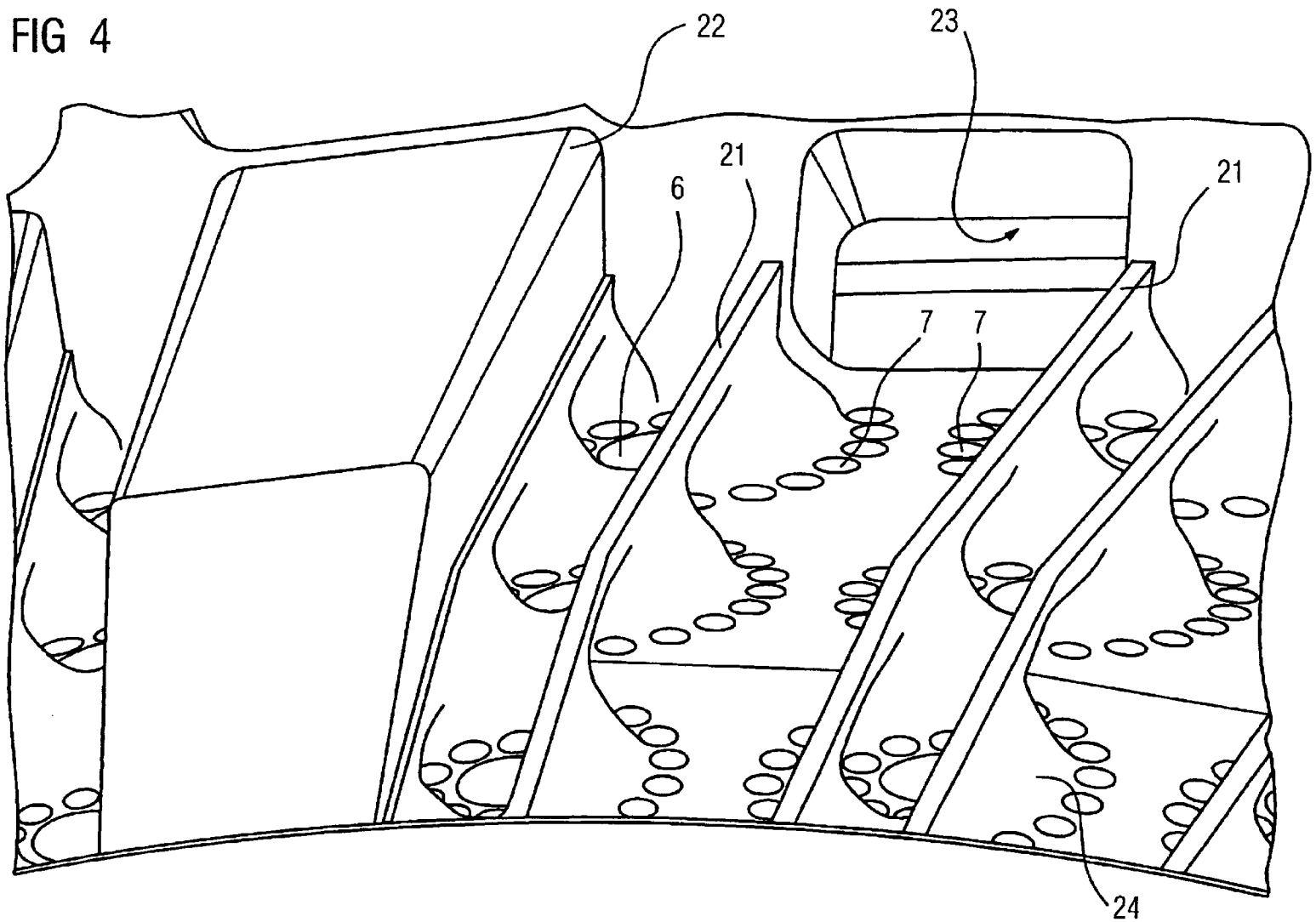

FIGS. 3 and 4 show a second embodiment of the invention. The outer wall 1 shown here is not configured as a hollow tile but comprises a single-layer wall 20, which comprises ribs 21 running in the axial direction of the combustion chamber. Covers 22 are placed on the ribs 21 and welded to the ribs to form drainage channels. The drainage channels thus formed open out into drainage openings 23, through which the discharged fluid exits. In the area between the ribs 21, on which the cover 22 rests, openings 7 open out to discharge cooling fluid. The area between the ribs 21, which is not covered by covers 22 to form drainage channels, contains circular openings 6 to feed in cooling fluid. In order to feed in the cooling fluid as comprehensively as possible and with even distribution, while keeping the drainage channels large enough, the ribs 21 are curved into a wave shape at their base in order to facilitate the transition to the circular openings 6. In this way cooling fluid entering between the drainage channels can penetrate in a shower over a large surface area into the intermediate space (not shown) between the outer wall 1 and an inner wall.

This embodiment as shown also allows reduced dimensioning of the outer wall in the radial direction of the combustion chamber. It also offers the advantage that the outer wall is simple to manufacture, as it is produced as a single-layer cast part with ribs and the covers are welded onto the ribs.

The exemplary embodiments shown are for illustration only and are not restrictive.

What is claimed is:

1. A combustion chamber with a closed cooling system for a turbine comprising:

an inner wall facing the combustion area;

an outer wall bounding the combustion area;

an intermediate space between the inner wall and the outer wall through which a cooling fluid can flow;

a cooling fluid feed system opening into the intermediate space; and a cooling fluid discharge for discharging the cooling fluid from the intermediate space, comprising a plurality of drainage structures extending substantially along the axial orientation of the combustion chamber, the drainage structures interrupted by inlet structures that feed the cooling fluid feed system; wherein the outer wall is configured as a double-layer hollow tile and the drainage structures are located inside the hollow tile and configured between walls of feed tubes arranged in rows one behind the other in the axial direction of the combustion chamber and projecting through the hollow tile to feed in the cooling fluid, whereby the feed tubes have an opening cross-section that is longitudinally extended in the axial direction of the combustion chamber at least in the outer layer of the hollow tile.

2. A combustion chamber according to claim 1, wherein the narrow sides of the feed tubes in the rows arranged in the axial direction of the combustion chamber are at a smaller distance from each other at least in the outer layer of the hollow tile than the distance between the openings in adjacent rows.

3. A combustion chamber according to claim 1, wherein the feed tubes in the outer layer of the hollow tile have an opening cross-section with a longitudinally extended form and in the inner layer of the hollow tile they have a circular opening cross-section.

4. A combustion chamber according to claim 1, wherein the outer layer of the hollow tile has a sealing plate that is attached, preferably screwed on, in a detachable manner, which seals an opening, through which a section of the inner layer that is attached, preferably screwed on, in a detachable manner is accessible.

5. A combustion chamber according to claim 1, wherein the drainage structures are formed by drainage channels formed on the outer wall, extending in the axial direction of the combustion chamber, between which the inlet structures are each arranged.

6. A combustion chamber according to claim 5, wherein circular drainage openings formed in the outer wall open out into the drainage channels.

7. A combustion chamber according to claim 5, wherein the drainage channels on the outer wall are formed by covers placed on ribs extending in the axial direction of the combustion chamber and configured on the outer wall.

8. A combustion chamber according to claim 7, wherein the ribs have at their base structures for facilitating the transition from circular openings to a linear channel.

9. A combustion chamber according to claim 7, wherein the outer wall is formed as a single-layer cast piece and the covers are welded onto the ribs.

10. A combustion chamber according to claim 2, wherein the feed tubes in the outer layer of the hollow tile have an opening cross-section with a longitudinally extended form and in the inner layer of the hollow tile they have a circular opening cross-section.

11. A combustion chamber according to claim 2, wherein the outer layer of the hollow tile has a sealing plate that is attached, preferably screwed on, in a detachable manner, which seals an opening, through which a section of the inner layer that is attached, preferably screwed on, in a detachable manner is accessible.

12. A combustion chamber according to claim 3, wherein the outer layer of the hollow tile has a sealing plate that is attached, preferably screwed on, in a detachable manner, which seals an opening, through which a section of the inner layer that is attached, preferably screwed on, in a detachable manner is accessible.

13. A combustion chamber according to claim 6, wherein the drainage channels on the outer wall are formed by covers placed on ribs extending in the axial direction of the combustion chamber and configured on the outer wall.

14. A combustion chamber according to claim 8, wherein the outer wall is formed as a single-layer cast piece and the covers are welded onto the ribs.

15. A combustion chamber according to claim 1, wherein the drainage structures are channel-type.

* * * * *